US007461685B2

(12) United States Patent
Overbury et al.

(10) Patent No.: US 7,461,685 B2
(45) Date of Patent: Dec. 9, 2008

(54) HEAT EXCHANGER

(75) Inventors: Alastair Overbury, East Ardsley (GB); Martin Timmins, West Yorkshire (GB); Adrian Mincher, Leeds (GB)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/602,726

(22) Filed: Nov. 21, 2006

(65) Prior Publication Data

US 2007/0131404 A1 Jun. 14, 2007

(30) Foreign Application Priority Data

Dec. 9, 2005 (GB) ..... 0525120.2

(51) Int. Cl.
*F28F 9/013* (2006.01)
*F28F 9/04* (2006.01)

(52) U.S. Cl. ..... 165/76; 165/178; 165/906

(58) Field of Classification Search ..... 165/76, 165/178, 906
See application file for complete search history.

(56) References Cited

U.S. PATENT DOCUMENTS 1,847,743 A * 3/1932 Anderson ..... 165/76
2,258,041 A * 10/1941 Young ..... 403/202
4,396,059 A * 8/1983 Banner et al. ..... 165/134.1
4,754,538 A * 7/1988 Stewart et al. ..... 29/890.031
2005/0199379 A1* 9/2005 Kimura et al. ..... 165/153
2005/0263263 A1* 12/2005 Merklein et al. ..... 165/76

FOREIGN PATENT DOCUMENTS

EP A-1562015 8/2005

OTHER PUBLICATIONS

Search Report from corresponding UK patent application No. GB0525120.2 dated Apr. 7, 2006.

* cited by examiner

*Primary Examiner*—Allen J Flanigan
(74) *Attorney, Agent, or Firm*—Harness, Dickey & Pierce, PLC

(57) ABSTRACT

A heat exchanger has a header plate with a plurality of openings and a plurality of tubes each having an end portion inserted into one of the plurality of openings in the header plate. Each of the plurality of tubes has a generally rectangular cross-section and a longitudinal axis. An end portion of at least some of the plurality of tubes is stiffened by a respective stiffening part. Each stiffening part includes two reinforcing elements positioned opposite each other abutting an inner surface of the tubes. Each reinforcing element also includes a back portion and two side portions extending from the back portion and a connecting member connecting the side portions of the reinforcing elements.

16 Claims, 6 Drawing Sheets

HEAT EXCHANGER

FIELD

The present invention relates to heat exchangers and in particular to Charge Air Coolers (CACs).

BACKGROUND

Heat exchangers are known in which a fluid heat exchange medium flows through a plurality of tubes. The tubes typically have a rectangular cross section and are mounted with an end portion in a header plate. In use, thermal stress can cause fatigue failure in the end portion of the tubes where they are mounted in the header plate. This reduces the life and reliability of the heat exchanger.

In order to overcome this problem it has been proposed to stiffen the ends of the tubes, particularly the tubes towards the edge of the heat exchanger which are more susceptible to thermal stress. In one known method, illustrated in FIG. 1, two separate stiffeners are inserted into the upper portions of a tube 4. The stiffeners 2 are then brazed in place during production. However, it is difficult to locate the stiffeners securely so that they abut the inner surface of the tube 4 and are at the correct depth.

A stiffener for heat exchanger tubes is also discussed in EP-A-1562015. This disclosure the use of insert members that comprise two solid insert portions joined by a connecting portion. The insert portions are bent out of the plane of the connecting portion to define a space through which coolant can flow. However, because the insert portions are solid, the stiffener must have a width corresponding to the internal width of the tube. If a different tube size is required it is necessary to change the thickness of the material from which the stiffener is made, increasing tooling costs for production. Furthermore, the use of a solid material restricts the available area of the tube for fluid flow.

SUMMARY

It is therefore an object of the invention to provide an improved structure of a heat exchanger.

Accordingly, the present invention provides a stiffening part comprising two reinforcing elements which are each generally U-shaped, having a back portion and side portions extending from the back portion. At least one connecting member connects the side portions of the reinforcing elements.

Such a stiffening part can be easily inserted into a tube of a heat exchanger and the U-shape of the reinforcing elements provides less of an obstruction to fluid flow.

According to an aspect of the invention, there is provided a heat exchanger comprising:

a header plate comprising a plurality of openings;

a plurality of tubes each having an end portion inserted into one of the plurality of openings in the header plate, each of the plurality of tubes having a generally rectangular cross-section and a longitudinal axis, wherein the end portion of at least some of the plurality of tubes is stiffened by a respective stiffening part, and wherein each stiffening part comprises:

two reinforcing elements positioned opposite each other abutting an inner surface of the tube, each reinforcing element comprising a back portion and two side portions extending from the back portion; and at least one connecting member connecting the side portions of the reinforcing elements.

The construction of the reinforcing elements allows fluid to flow between the side portions, presenting less of a restriction to fluid flow than the insert members of EP-A-1562015.

Furthermore, the stiffening part can be formed from a single piece of metal by press-forming. The stiffening part can be adjusted to different tube dimensions simply by altering the press-forming process, there is no need to use a different metal width as is required in EP-A-1562015. Furthermore, the heat exchanger is better suited for use as an intercooler than the heat exchanger of EP-A-1562015. The tube height of an intercooler is higher than a radiator and it is not possible to reinforce both corners and the tube end using the insert of EP-A-1562015, unlike the heat exchanger of the present invention.

Preferably, the back portion of at least one of the two reinforcing elements comprises a groove parallel to the longitudinal axis of the tube. In practice, the tube will have an internal weld running along its length on it's inner surface. The groove allows the stiffening part to be inserted in the heat exchanger without catching on or damaging the internal weld, allowing for easier insertion and avoiding the possibility of damage to the weld.

Preferably, the side portions of the two reinforcing elements are tapered in a direction parallel to the longitudinal axis such that the distance they extend from the base member is smaller the greater the distance from the end of the tube. By tapering the side portions the reinforcing elements can minimise damage to any internal fins that may be formed in the tube. If the side portion is not tapered it is necessary to remove a portion of the internal fins where the stiffening part is inserted, increasing the complexity of production.

Preferably, the at least one connecting member connects an upper part of the side portions and is offset from the side portions such that the connecting member abuts an end surface of the tube. In that case the connecting member can also act to positively seat the stiffening part in the connect position at the end of the tube, ensuring that it is inserted to the correct depth. More preferably, the connecting member is parallel to an inner surface of the tube, ensuring that it does not restrict the flow through the tube and also allowing a smaller spacing between adjacent tubes.

Preferably, the stiffening part comprises a single connecting member connecting one side portion of each reinforcing element. If only one connecting member is present, the stiffening element can be easily formed by press-forming.

Alternatively, there may be two connecting members for connecting both side portions of the two reinforcing elements to the respective opposite side portions. The stiffness of the stiffening element can be improved if two connecting members are used.

If there are two connecting members, the stiffening part further comprises a brace member extending between the two connecting members. The stiffness can be further improved by the brace member.

Preferably, the at least one connecting member comprises a deformable portion to allow the distance between the reinforcing elements to be altered. The deformable portion may be resiliently (elastically) deformable or plastically deformable. This ensures that the back portions are located firmly against the inner surface of the tube. A further advantages is that it allows the manufacturing tolerances to be lower while still ensuring that the back portions of the reinforcing elements have good contact with the inner surface.

Preferably, the deformable portion is formed by a central section of the connecting member, the central section having the form of an arc around an axis parallel to the longitudinal axis of the tube. If the deformable portion has this form it has the further advantage of improving torsional stiffness of the stiffening part about an axis perpendicular to the longitudinal axis of the tube.

In one embodiment, the stiffening element comprises four reinforcing elements, two of the four reinforcing elements are positioned opposite each other abutting an inner surface of a first tube, and the other two of the four reinforcing elements are positioned opposite each other abutting an inner surface of a second tube adjacent to the first tube, each reinforcing element comprising a back portion and two side portions extending from the back portion; and wherein there is one connecting member that connects all four reinforcing elements. This allows a single part to reinforce the ends of two adjacent tubes, improving the ease of assembly.

Preferably, the side portions of the reinforcing elements are spaced a greater distance apart than the width of the tube. The side portions are then positively abutting the walls of the tube and will act to push the walls against the edges of the opening in the header plate.

Preferably, the reinforcing elements and the at least one connecting member define a substantially planar upper edge. This enables more easy insertion of the stiffening part.

DRAWINGS

Embodiments of the invention will now be described by way of example with reference to the accompanying drawings, in which.

DESCRIPTION

Figure 1:
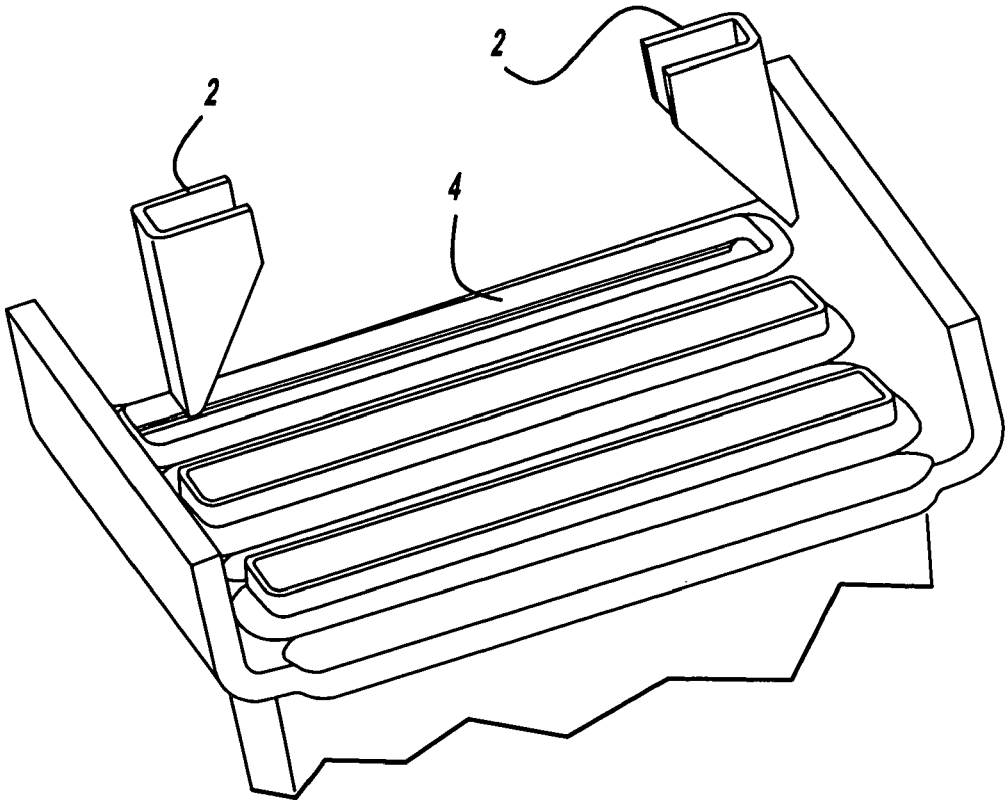
FIG. 1 depicts a prior art tube stiffener.

Like reference numerals denote like parts throughout the description and drawings.

Figure 2:
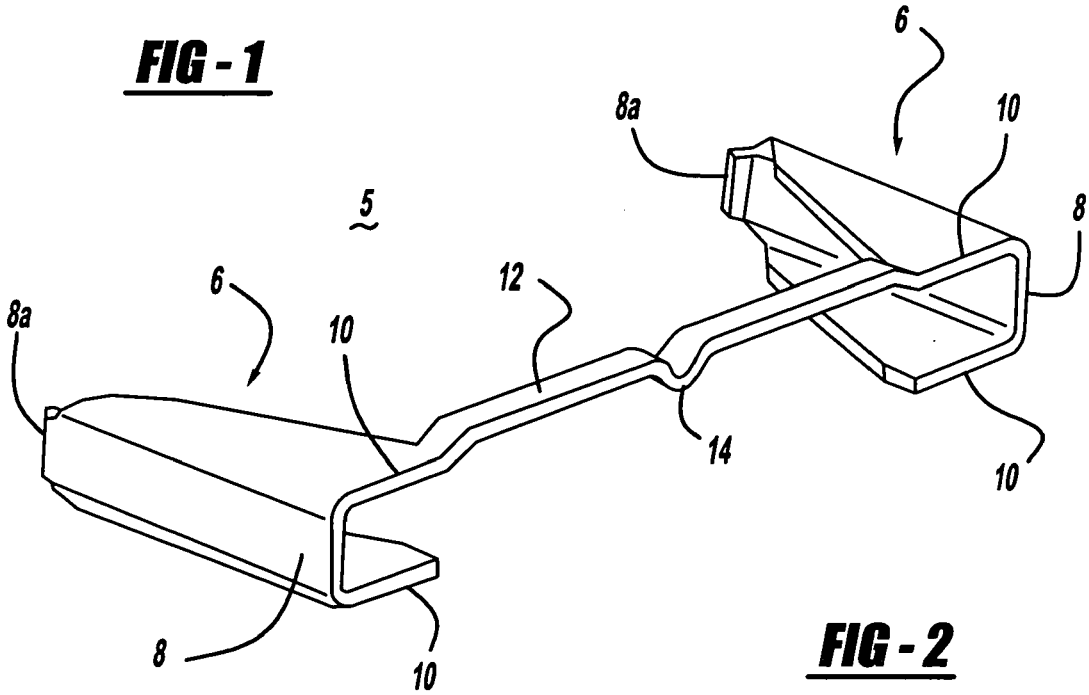
FIG. 2 depicts a first embodiment of a tube stiffener for use in a heat exchanger according to the present invention.

A first embodiment of a tube stiffener 5 for use in a heat exchanger according to the present invention is depicted in FIG. 2. The stiffener comprises two reinforcing elements 6. Each reinforcing element comprises a back portion 8 and two side portions 10 that extend from the back portion 8. A connecting member 12 joins two of the side portions 10 to position the two reinforcing elements 6 for insertion into a tube. The side portions 10 are tapered so that they have a generally triangular shape with the side portions 10 extending furthest from the back portion 8 adjacent the connecting member 12. Rear side ends of the back portions 8, the side portions 10 and the connecting member 12 are aligned on a plane. Front side ends of the back portions 8 provides distal ends 8*a*. The distal ends 8*a* slightly protrude longer than the side portions 10. The distal ends 8*a* slightly narrower than that between the side portions 10 and are inwardly rolled to allow easier insertion of the tube stiffener.

A deformable portion 14 is provided in the connecting member 12. In this embodiment the deformable portion is in the form of an arc. The arc is formed about an axis which is parallel with the longitudinal axis of the tube into which the stiffener is to be inserted (see FIG. 3). The connecting member 12 in this embodiment is also offset outwardly from the plane of the side portions 10 which it connects.

Figure 3:
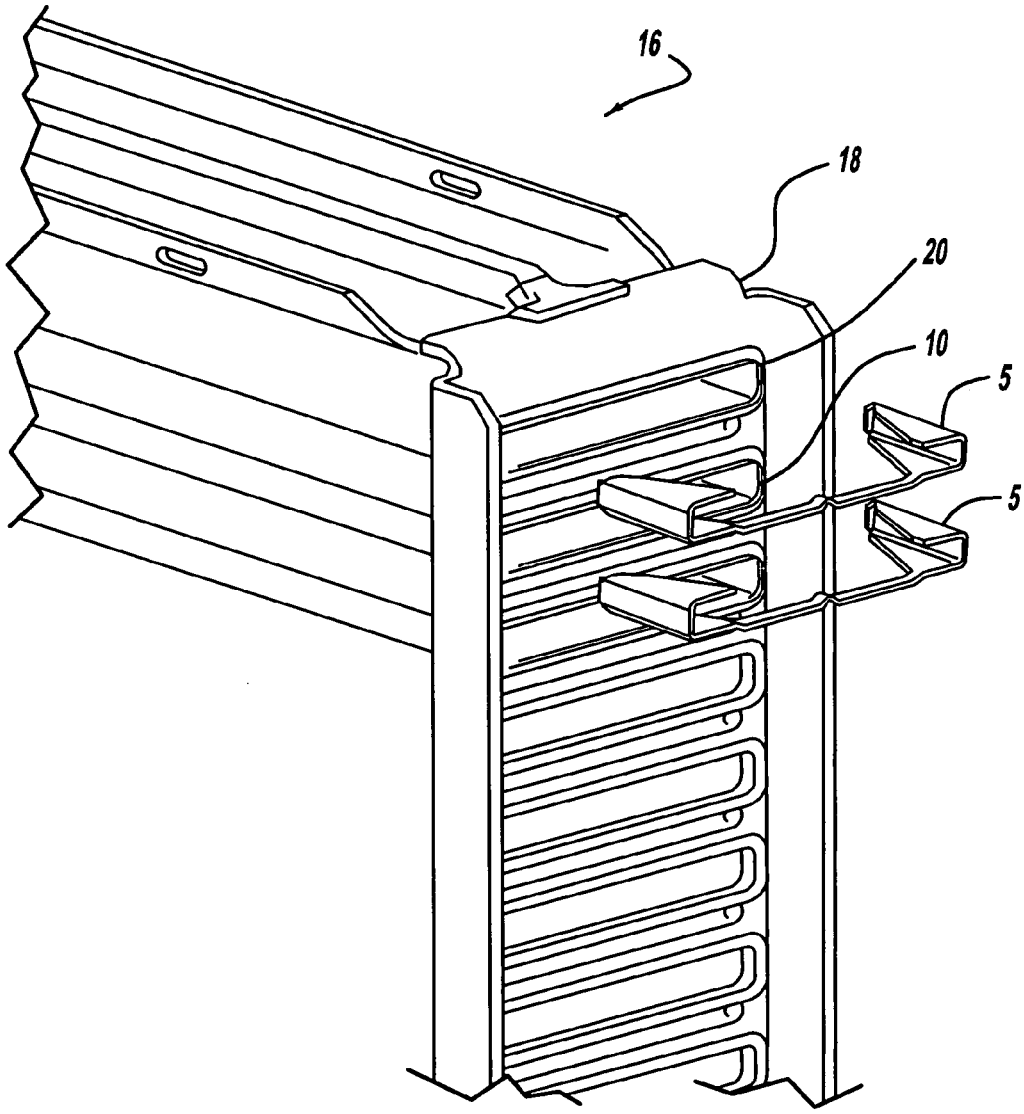
FIG. 3 depicts a part of a heat exchanger with the tube stiffener of FIG. 2 in position to be inserted in a tube.

FIG. 3 illustrates a portion of a heat exchanger 16 into which the tube stiffener 5 is to be inserted. In this embodiment the heat exchanger 16 is a Charge Air Cooler (CAC). The heat exchanger comprises a header plate 18 in which several openings are formed to receive tubes 20 through which a heat exchange medium can flow. The header plate 18 provides a part of a wall of a header tank through which fluid is distributed to the tubes 20 or collected from the tubes 20. As can be seen in FIG. 3, the tubes 20 are generally rectangular in cross section, with two long and two short sides, and have an end portion inserted into the header plate 18. The tubes preferably have corrugated (or wavy) fins (21 in FIG. 5) located between them to enhance heat transfer.

The stiffener 5 has dimensions such that it can be inserted in the end of a tube 20 so that the back 8 and side portions 10 of the reinforcing elements abut an inner surface of the tube. The deformable portion 14 allows the distance between the back portion 8 of the reinforcing elements to be slightly larger than the internal dimension along the long sides of the tubes 20. The side portions 10 are also preferably slightly wider apart than the internal dimension along the short sides of the tubes 20. The connecting member 12 is formed in a thin and narrow strip and is only placed between rear ends of the side portions 10. The deformable portion 14 is inwardly offset from the straight portion of the connecting member 12.

The stiffeners 5 need not be inserted into every tube 20 of the heat exchanger 16. However, it is preferable for the stiffeners 5 to be inserted into tubes located outside region or the outermost tubes as these are most subject to thermal stress. In this embodiment, the stiffeners 5 are inserted into the outermost two tubes.

Figure 4:
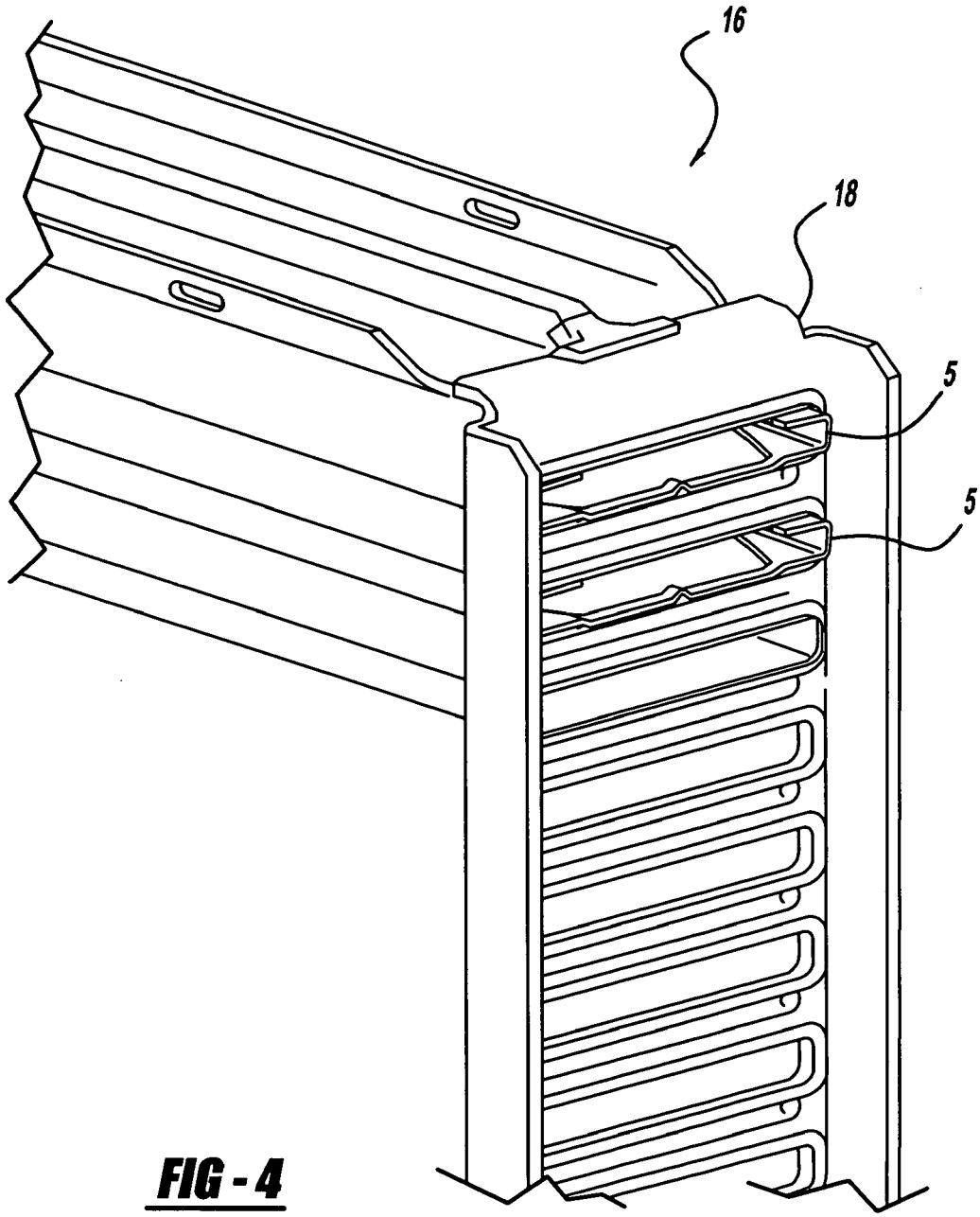
FIG. 4 depicts the part of the heat exchanger of FIG. 3 with the tube stiffener inserted.

FIG. 4 depicts the heat exchanger 16 with the stiffeners 5 installed. On insertion into the tube the deformable portion 14 deforms to allow the two reinforcing elements to move towards each other. This ensures that good contact between the back portions 8 and the short internal surface of the tube is achieved. Likewise, the side portions 10 deform inwards slightly as the stiffener is inserted. This ensures good contact between the side portions and the long sides. Another benefit is that the tube itself will deform outwards slightly so that its outer surface is more securely seated in the opening in the header plate 18.

A further benefit of the arcuate form of the deformable portion 14, is that it acts to increase the torsional stiffness of the stiffener about an axis parallel to the connecting member 12 (perpendicular to the axis of the tube).

In a CAC, the tubes 20 preferably include internal fins (not shown). The triangular shape of the side portions enables the tube stiffener to be inserted with minimum interference with the internal fins.

Figure 5:
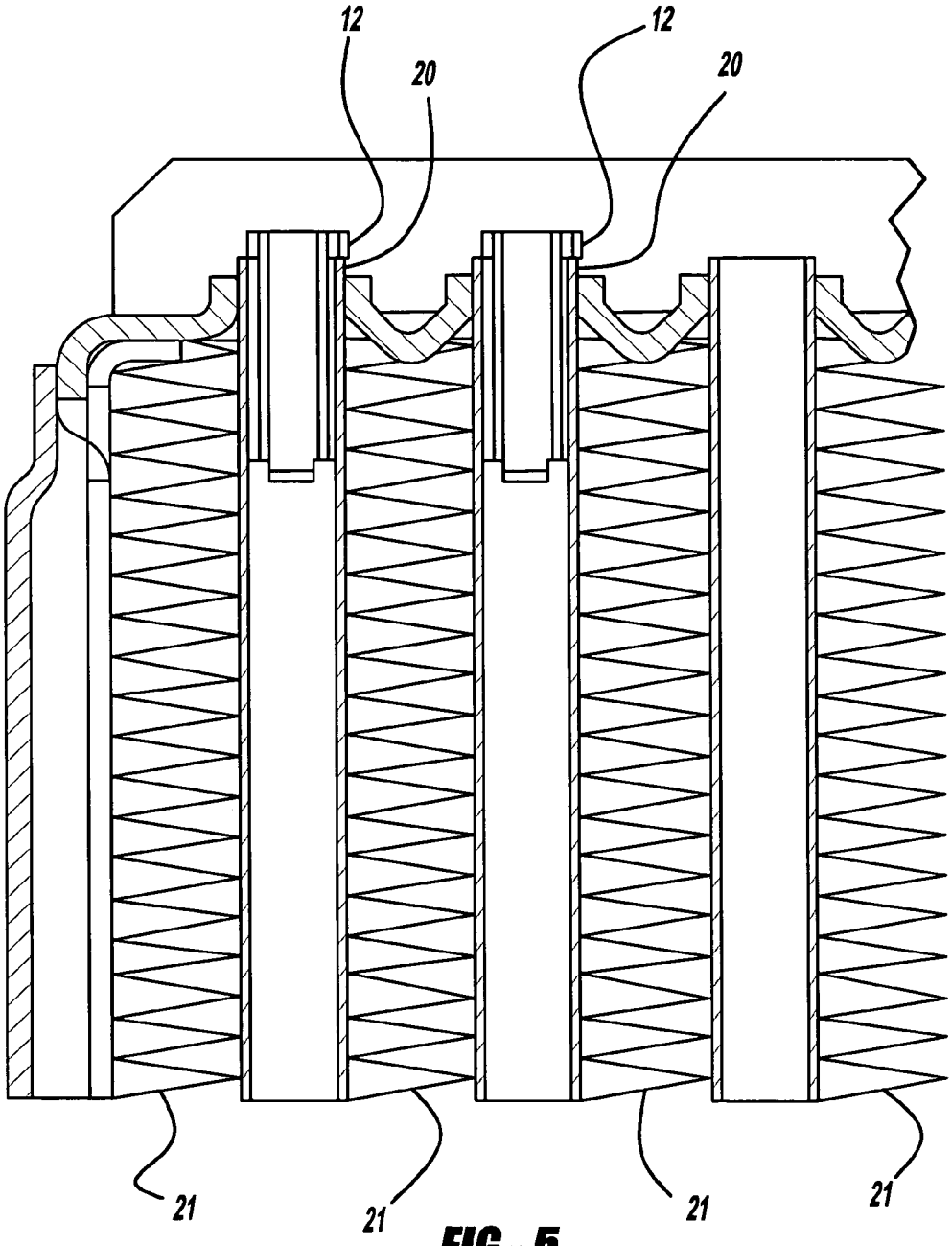
FIG. 5 depicts a cross section of a heat exchanger with a tube stiffener according to the first embodiment installed.

Insertion of the stiffener is assisted by the use of the connecting member. The reinforcing elements are held the correct distance apart and the edges of reinforcing elements 6 and the connecting member 12 define a single plane to enable the stiffener to be easily gripped by a user. The offset of the connecting member 12 means that when the stiffener has been fully inserted the connecting member 12 abuts an end edge of the tube. This ensures that the stiffener is inserted to the correct depth. FIG. 5 depicts a cross section of the stiffener inserted into the tubes 20 and the offset of the connecting member 12 (engaging with a top edge of the tube) can be seen. FIG. 5 also illustrates how the connecting member 12 is parallel with the internal of a long side of the tube 20. This avoids the connecting member 12 interfering with flow of fluid through the tube and also requires minimal space adjacent the tube to accommodate the connecting member 12.

It is possible for the stiffener 5 to be manufactured by several processes. However, it is preferred to use press-forming from sheet metal. This is a simple and cheap process which can form all the features of the stiffener.

During construction of the heat exchanger, the stiffener 5 is inserted into the end of the tube after it has been installed in the header plate. The stiffener and tube are then brazed.

Figure 6:
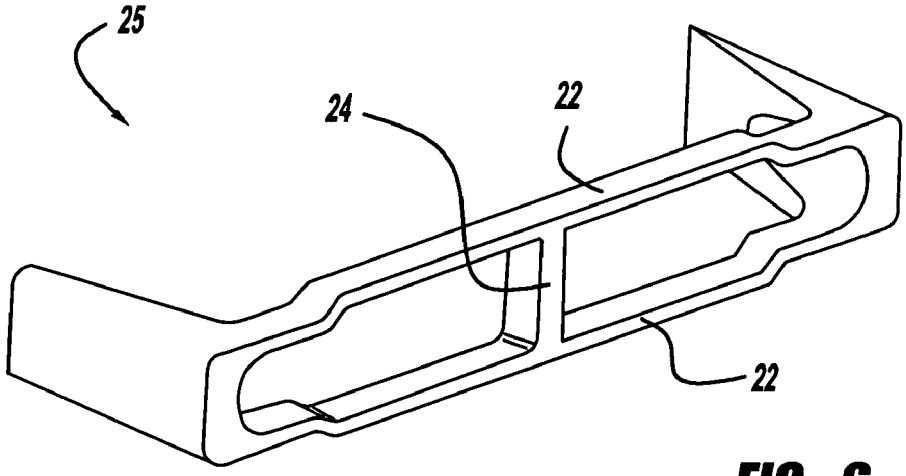
FIG. 6 depicts a second embodiment of a tube stiffener for a heat exchanger according to the present invention.

A second embodiment of a stiffener 25 for a heat exchanger according to the present invention is depicted in FIG. 6. This embodiment is the same as the first embodiment save as described below. In this embodiment, two connecting members 22 are provided connecting each of the side portions. The deformable portion of the first embodiment is replaced with a central brace member 24 extending between the two connecting members 24. The brace member acts to increase the rigidity of the stiffener.

Figure 7:
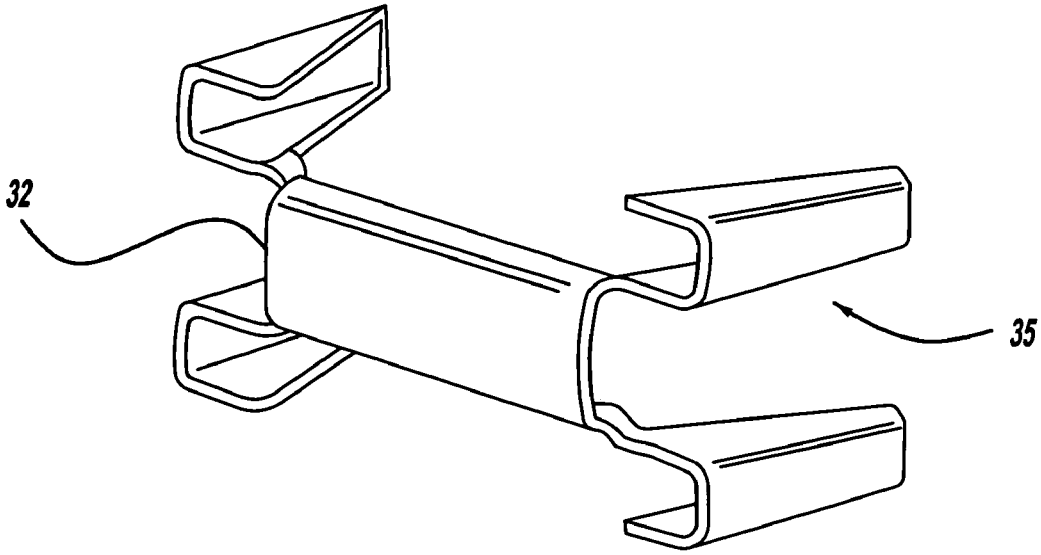
FIG. 7 depicts a third embodiment of a tube stiffener for a heat exchanger according to the present invention.

A third embodiment of a stiffener 35 for a heat exchanger according to the present invention is depicted in FIG. 7. This embodiment is the same as the first embodiment save as described below. In this embodiment, a single stiffener is for insertion into two adjacent tubes in the heat exchanger. Four reinforcing elements (two for each tube) are connected by a single connection member 32. When it is desired to stiffen the ends of two adjacent tubes, this embodiment improves the ease of assembly of the heat exchanger.

Figure 8:
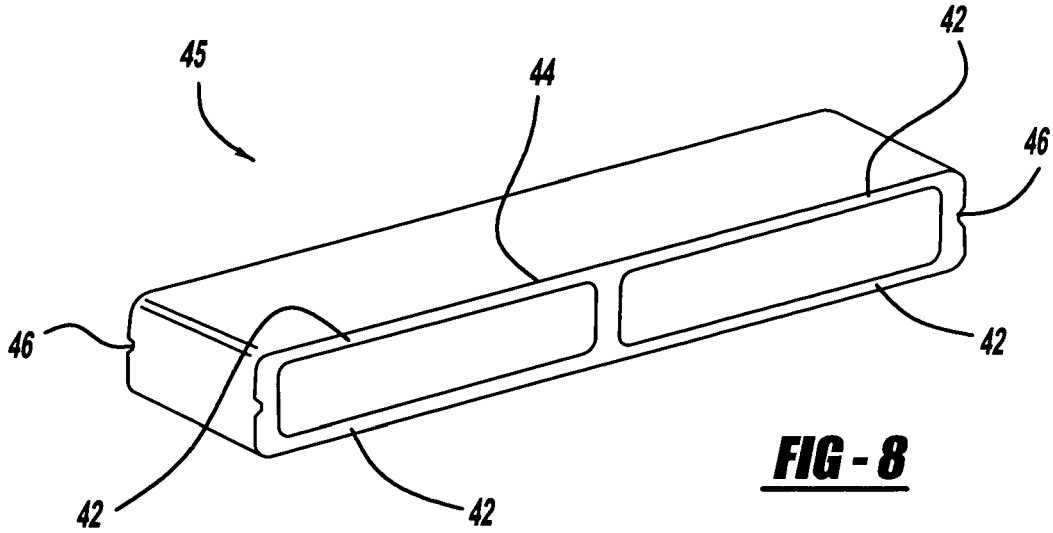
FIG. 8 depicts a fourth embodiment of a tube stiffener for a heat exchanger according to the present invention.

A fourth embodiment of a stiffener 45, for a heat exchanger according to the present invention is depicted in FIG. 8. This embodiment is the same as the second embodiment save as described below. The side portions 42 do not taper and the connecting members 44 are not offset from the side portions, resulting in a generally cuboidal shape. Preferably, this embodiment is used with a tube having internal fins that have been removed from the end of the tube to the desired inserting depth of the stiffener 45. In that way the correct insertion depth can be determined by inserting the stiffener 45 until the side portions 42 and connecting members 44 abut the fins where they have not been cut away.

Figure 9:
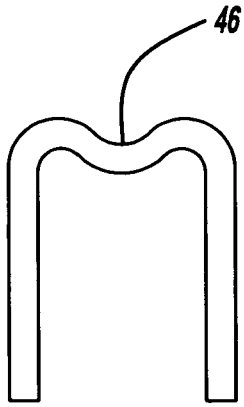
FIG. 9 is a cross section of a reinforcing element illustrating a groove for accommodating a weld.

This embodiment also includes a groove 46 in the back portion of the reinforcing elements. It is common for the tubes of the heat exchanger to include an internal weld. The groove 46 allows the stiffener to be inserted without fouling on the groove while still ensuring good contact between the back portion and the inner surface of the groove. A cross section showing the groove 46 is depicted in FIG. 9. The groove can be applied to any of the embodiments.

The present invention therefore provides a heat exchanger in which a stiffening element can be easily and accurately inserted into the end of the tube to reduce the effects of thermal stress.

The invention claimed is:

1. A heat exchanger comprising:

a header plate comprising a plurality of openings:

a plurality of tubes, each tube having an end portion inserted into one of the plurality of openings in the header plate, each of the plurality of tubes having a generally rectangular cross-section and a longitudinal axis, wherein the end portion of at least some of the plurality of tubes is stiffened by a respective stiffening part, and wherein each stiffening part comprises:

two reinforcing elements positioned opposite each other abutting an inner surface of the same tube, each reinforcing element comprising a back portion and two side portions extending from the back portion; and at least one connecting member directly connecting the side portions of said two reinforcing elements.

2. A heat exchanger according to claim 1, wherein the back portion of at least one of the two reinforcing elements comprises a groove parallel to the longitudinal axis of the tube.

3. A heat exchanger according to claim 1, wherein the side portions of the two reinforcing elements are tapered in a direction parallel to the longitudinal axis such that the distance they extend from the back portion is smaller the greater distance the side portions extend from the end of the tube.

4. A heat exchanger according to claim 1, wherein the at least one connecting member connects only an upper part of the side portions and is offset from the side portions such that the connecting member abuts an end surface of the tube.

5. A heat exchanger according to claim 1, wherein the at least one connecting member connects a side portion of each reinforcing element.

6. A heat exchanger according to claim 1, wherein the at least one connecting member comprises a first connecting member connecting a first side portion of each reinforcing element and a second connecting member connecting a second side portion of each reinforcing element.

7. A heat exchanger according to claim 6, further comprising a brace member extending between the first and second connecting members.

8. A heat exchanger according to claim 1, wherein the at least one connecting member comprises a deformable portion to allow the distance between the two reinforcing elements to be altered.

9. A heat exchanger according to claim 8, wherein the deformable portion is formed by a central section of the connecting member, said central section having the form of an arc around an axis parallel to the longitudinal axis.

10. A heat exchanger according to claim 1, wherein the stiffening part comprises four reinforcing elements, two of the four reinforcing elements positioned opposite each other abutting an inner surface a first tube, and the other two of the four reinforcing elements positioned opposite each other abutting an inner surface of a second tube adjacent to the first tube, each reinforcing element comprising a back portion and two side portions extending from the back portion and wherein there is one connecting member that connects all of four reinforcing elements.

11. A heat exchanger according to claim 1, wherein the side portions of the reinforcing elements are spaced a greater distance apart than the width of the tube.

12. A heat exchanger according to claim 1, wherein the reinforcing elements and the at least one connecting member define a substantially planar upper edge.

13. A heat exchanger comprising:

a header plate comprising a plurality of openings:

a plurality of tubes each having an end portion inserted into one of the plurality of openings in the header plate, each of the plurality of tubes having a generally rectangular cross-section and a longitudinal axis, wherein the end portion of at least some of the plurality of tubes is stiffened by a respective stiffening part, and wherein each stiffening part comprises:

two reinforcing elements positioned opposite each other abutting an inner surface of the tube, each reinforcing element comprising a back portion and two side portions extending from the back portion; and at least one connecting member connecting the side portions of the reinforcing elements; wherein the stiffening part comprising single connecting member connecting one side portion of each reinforcing element.

14. A heat exchanger comprising:

a header plate comprising a plurality of openings:

a plurality of tubes each having an end portion inserted into one of the plurality of openings in the header plate, each of the plurality of tubes having a generally rectangular cross-section and a longitudinal axis, wherein the end portion of at least some of the plurality of tubes is stiffened by a respective stiffening part, and wherein each stiffening part comprises:

two reinforcing elements positioned opposite each other abutting an inner surface of the tube, each reinforcing element comprising a back portion and two side portions extending from the back portion; and at least one connecting member connecting the side portions of the reinforcing elements; wherein there are two connecting members for connecting both side portions of the two reinforcing elements to the respective opposite side portions, and the heat exchanger further comprises:

a brace member extending between the two connecting members.

15. A heat exchanger comprising:

a header plate comprising a plurality of openings:

a plurality of tubes each having an end portion inserted into one of the plurality of openings in the header plate, each of the plurality of tubes having a generally rectangular cross-section and a longitudinal axis, wherein the end portion of at least some of the plurality of tubes is stiffened by a respective stiffening part, and wherein each stiffening part comprises:

two reinforcing elements positioned opposite each other abutting an inner surface of the tube, each reinforcing element comprising a back portion and two side portions extending from the back portion; and at least one connecting member connecting the side portions of the reinforcing elements; wherein the at least one connecting member comprises a deformable portion to allow the distance between the reinforcing elements to be altered; and the deformable portion is formed by a central section of the connecting member, said central section having the form of an arc around an axis parallel to the longitudinal axis.

16. A heat exchanger comprising:

a header plate comprising a plurality of openings:

a plurality of tubes each having an end portion inserted into one of the plurality of openings in the header plate, each of the plurality of tubes having a generally rectangular cross-section and a longitudinal axis, wherein the end portion of at least some of the plurality of tubes is stiffened by a respective stiffening part, and wherein each stiffening part comprises:

two reinforcing elements positioned opposite each other abutting an inner surface of the tube, each reinforcing element comprising a back portion and two side portions extending from the back portion; and at least one connecting member connecting the side portions of the reinforcing elements; wherein the stiffening part comprises four reinforcing elements, two of the four reinforcing elements positioned opposite each other abutting an inner surface a first tube, and the other two of the four reinforcing elements positioned opposite each other abutting an inner surface of a second tube adjacent to the first tube, each reinforcing element comprising a back portion and two side portions extending from the back portion and wherein there is one connecting member that connects all of four reinforcing elements.

* * * * *